US008388403B2

(12) United States Patent
Seter

(10) Patent No.: US 8,388,403 B2
(45) Date of Patent: Mar. 5, 2013

(54) TRAY SYSTEM

(76) Inventor: Helga Seter, Brookfield, WI (US)

( * ) Notice: Subject to any disclaimer, the term of this patent is extended or adjusted under 35 U.S.C. 154(b) by 146 days.

(21) Appl. No.: 12/839,574

(22) Filed: Jul. 20, 2010

(65) Prior Publication Data

US 2011/0036745 A1 Feb. 17, 2011

Related U.S. Application Data

(60) Provisional application No. 61/233,663, filed on Aug. 13, 2009.

(51) Int. Cl.
*A63H 33/42* (2006.01)
*A47B 85/00* (2006.01)

(52) U.S. Cl. ..... 446/227; 108/26

(58) Field of Classification Search ..... 446/70, 446/75, 227, 479, 482; 108/25, 26; 472/126
See application file for complete search history.

(56) References Cited

U.S. PATENT DOCUMENTS 4,416,438 A * 11/1983 King ..... 248/102
D341,912 S * 11/1993 Ayala ..... D30/153
6,109,188 A * 8/2000 Russell ..... 108/44
6,212,705 B1 * 4/2001 Kramer ..... 4/559
6,216,605 B1 * 4/2001 Chapman ..... 108/26
6,581,210 B2 * 6/2003 Kaloustian ..... 2/49.1

* cited by examiner

*Primary Examiner* — Kien Nguyen
(74) *Attorney, Agent, or Firm* — Aidenbaum Schloff and Bloom PLLC.; Jay Scloff

(57) ABSTRACT

A tray system for retaining items on a tray and preventing items from falling onto a surface comprises a tray and at least one cord attached thereto. Engagement features at the end of the cord that is distal to the tray may securely attach to a toy, a food item, an item of dishware, drinkware, or flatware, or any other small item. The cord is preferably of a length such that attached items cannot reach the floor if they are dislodged from the tray and otherwise short enough so as not to be a safety hazard. The system further comprises fasteners disposed on an underside of the tray, for retaining the tray in a position or to a larger item, and fasteners on a topside of the tray, for securing items to the surface of the tray. The surface of the tray may also have a plurality of compartments thereon.

11 Claims, 6 Drawing Sheets

TRAY SYSTEM

CROSS REFERENCE TO RELATED APPLICATIONS

The present disclosure is a claims priority on the U.S. Provisional Patent Application Ser. No. 61/233,663, filed on Aug. 13, 2009, the disclosure of which is incorporated by reference.

FIELD OF THE DISCLOSURE

The present disclosure relates generally to devices for supporting and retaining objects such as food items, and more particularly, to a tray for holding and retaining objects so that spills out of such objects are minimized and so that such objects do not fall out of reach and remain easily retrievable in the event that they are moved off of the tray.

BACKGROUND OF THE DISCLOSURE

Feeding a toddler or young child usually involves seating the toddler or child at a high chair or table, and more particularly, utilizing a tray to present and arrange the various food items and utensils that are to be fed to the toddler or child. When feeding a toddler or child, caregivers often find themselves picking up from the floor food items and/or utensils that have fallen off of the tray or the table, or that the toddler or child has thrown from the table. However, once these items and utensils have fallen to the floor, they are usually rendered inedible or unusable due to the unsanitary condition of the floor. As a result, food goes wasted and more utensils are require during the feeding process.

Hospitals and other medical care facilities face similar situations. Namely, adult caregivers often are called upon to feed and administer adult patients. These patients may inadvertently or intentionally attempt to knock food items and utensils from a tray or table on which the caregiver has placed the food items and utensils. Furthermore, adult patients (being stronger than toddlers and children) may attempt to knock off the food tray itself (although some children may be strong enough to attempt to do this themselves.) Again, in either case, there are unpleasant results when food items and or utensils are moved from a tray or table to an unsanitary floor.

Traditional trays and utensil arrangements do not solve these problems, as the trays do not secure themselves to tables or other surfaces on which they are placed. Further, such traditional trays do not include retention features for removably attaching utensils to the trays.

Accordingly, there exists a need for a tray system that overcomes all of the disadvantages of the prior art, while still retaining the advantages of the prior art.

SUMMARY OF THE DISCLOSURE

In view of the foregoing disadvantages inherent in the prior art, the general purpose of the present disclosure is to provide a tray system, configured to include all the advantages of the prior art, and to overcome the drawbacks inherent therein.

Accordingly, an object of the present disclosure is to provide a tray system, where the tray system includes a tray that is capable of having items attach thereto via at least one cord and of retaining said attached items, such that the items, if thrown or dislodged from the tray will not reach the floor or other unsanitary surface and may otherwise remain in reach of the person that is using the tray system for him- or herself, or of the reach of a caregiver that is using the tray system in connection with feeding a toddler or an elderly and infirm person.

Another object of the present disclosure is to provide a tray system that includes a tray that is capable of being securely attached to a table or other surface, such that a user cannot easily dislodge the tray from the table or surface.

Yet another object of the present disclosure is to provide a tray system that includes a tray with a plurality of compartments on a storage region of the tray, which compartments may separate different food items for purposes of cleanliness or taste, for example, and which storage region of the tray may further comprise attachment features disposed thereon, such that larger items such as plates, bowls, and the like may be securely and immovably attached to the storage region of the tray.

In light of the above objects, in one aspect of the present disclosure, a tray system is provided. The system includes a tray, which tray comprises a substantially flat platform section, which platform section may include a plurality of walls extending upwardly away from the platform section at a periphery of the platform section. The system further comprises at least one cord, which at least one cord may be removably attached to the tray and may be capable of attaching to and securing an item, such as a plate, cup, knife, fork, a food item, a pacifier, a child's toy, and the like. It will be apparent that the at least one cord may be of such a length that, when it is fully extended away from the tray, it and the object attached thereto will not reach a floor or other unsanitary surface that is in proximity to the tray system. The length of the at least one cord will also preferably be short enough to prevent the cord from being a choking or asphyxiation hazard to the person using the tray system.

In another aspect of the present disclosure, a tray system further provides at least one fastener on an underside of the platform section of the tray, which at least one fastener may securely attach the tray of the tray system to a surface such as a table, highchair, walker, or hospital tray. Examples of such at least one fastener include, but are not necessarily limited to suction cups, clamps, straps, and the like.

In another embodiment, the platform section of the tray of a tray system comprises a plurality of compartments, which compartments may be formed by a plurality of ridges or walls that extend across the interior of the platform section. The compartments may keep items that are placed on the tray separate from one another. The compartments may also be so configured as to be able to mate with items of dishware, flatware, and/or drinkware, so as to as to securely receive and retain such items that may be placed on the tray. In an alternate embodiment, the platform section of the tray may have engagement features (such as clips, for example) that may retain the items of dishware, flatware, and/or drinkware on the tray.

These together with other aspects of the present disclosure, along with the various features of novelty that characterize the present disclosure, is pointed out with particularity in the claims annexed hereto and forms a part of this present disclosure. For a better understanding of the present disclosure, its operating advantages, and the specific objects attained by its uses, reference should be made to the accompanying drawing and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in composition, structure, and design. It should be emphasized, however, that the present disclosure is not limited to a tray or tray system as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

Unless limited otherwise, the terms "coupled," "attached," and variations thereof herein are used broadly and encompass direct and indirect arrangements. The terms "a" and "an" herein do not denote a limitation of quantity, but rather denote the presence of at least one of the referenced items.

Figure 1:
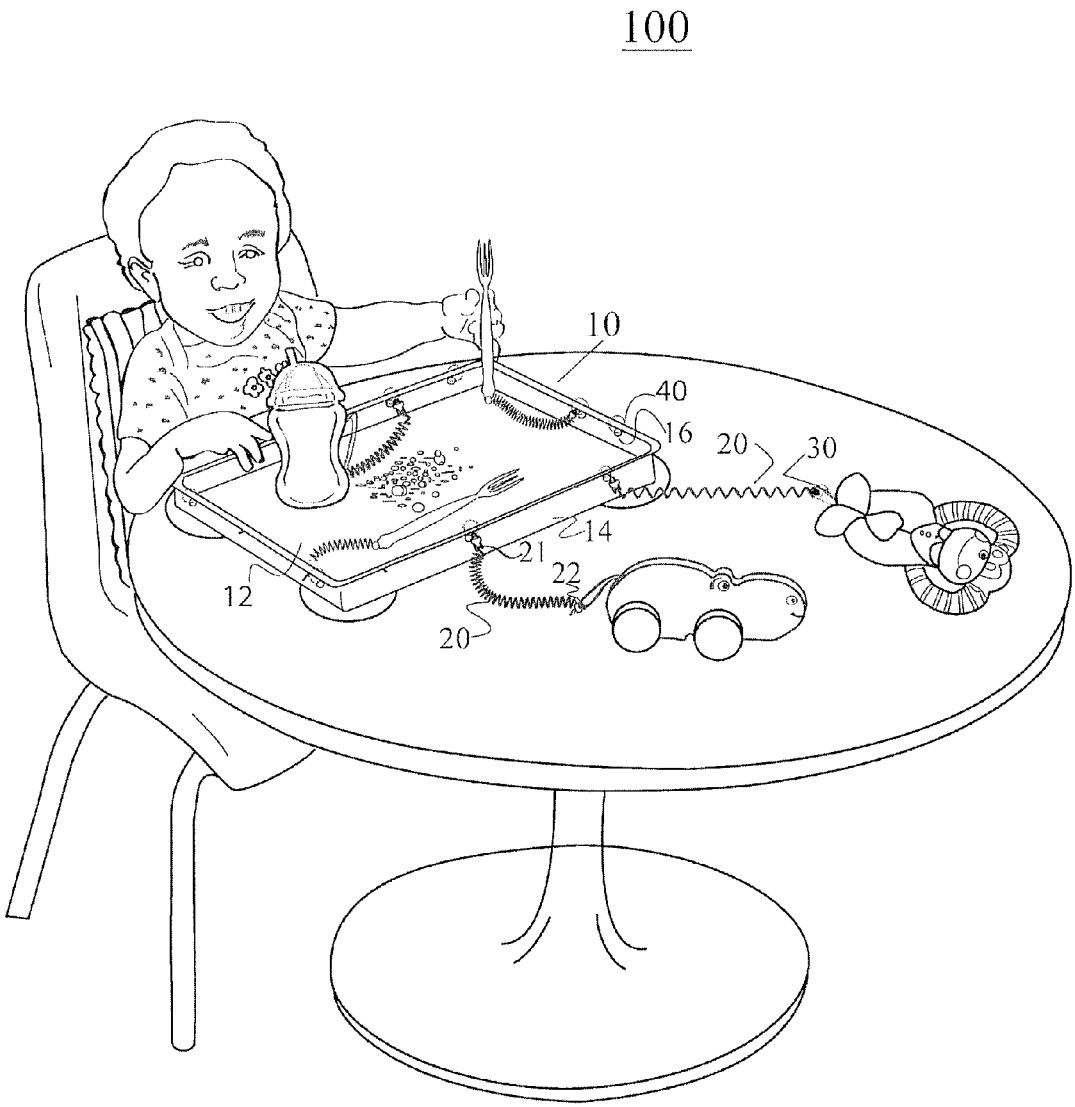
FIG. 1 illustrates a perspective view of a tray system, in accordance with an embodiment of the present disclosure.

Referring now to FIG. 1, the present disclosure provides a tray system 100 for securing and retaining items placed on a tray 10. The system comprises a tray 10 and at least one cord 20 attached to the tray. The tray 10 of the system 100 comprises a substantially flat platform section 12, which platform section 12 may include a plurality of exterior walls 14 extending upwardly away from the platform section 12 at a periphery of the platform section. In an embodiment, the exterior walls 14 may extend approximately one inch away from the platform section 12 of the tray 10.

The at least one cord 20 comprises a first end 21 and a second end 22. Preferably, the first end 21 of the at least one cord 20 will be the end that is attached to the tray. The second end 22 of the cord 20 will preferably include engagement features 30, such as a clip, a clamp, an elastic band, a hook, a pin, and the like. It will be understood that the engagement features 30 disposed on the second end 22 of the cord 20 will be capable of attaching to and securing an item of dishware, flatware, and/or drinkware, a food item, a pacifier, or a toy, for example. The at least one cord 20 of the tray system is preferably elastic and will be of a length such that, when the cord is fully extended away from the tray 10, sufficient distance will remain between the item attached to the second end 22 of the cord and the floor or ground of the room or place at which a user is using the tray system 100. Further, in use, the at least one cord 20 will remain within reach of a user such that the user (or his or her caregiver) may easily retrieve an item attached to the at least one cord 20 that has been dislodged from the tray 10 of the system 100. It will be understood that the cord will also preferably be short enough to prevent the cord from being a choking or asphyxiation hazard to the person using the tray system.

Attachment of the first end 21 of the at least one cord 20 to the tray 10 may be accomplished by a fastener arrangement 40 that is sufficient to permanently or removably secure the at least one cord 20 to the tray 10. An example of such a fastener arrangement 40 for removably securing the first end 21 of the at least one cord 20 to the tray 10 is an aperture 16 on a wall 14 of the tray 10 through which the cord may be drawn (wherein the first end 21 of the cord 20 can then be knotted to prohibit passage of the first end 21 of the cord 20 back through the aperture. Another example is a bolt snap disposed at the first end 21 of the cord 20, which bolt snap may attach to an aperture 16 on a wall 14 of the tray 10. Another example is ring that may be disposed on a wall 14 of the tray 10, to which the first end 21 of the cord 20 may be tied.

In an embodiment, and shown in FIG. 1, a fastener arrangement 40 for permanently securing the first end 21 of the at least one cord 20 to the tray 10 comprises a ring to which the at least one cord 20 is affixed. Another exemplary fastener arrangement 40 may be a crimp that may applied to the first end 21 of the at least one cord 20, after the first end 21 of the cord 20 is drawn through an aperture 16 on a wall 14 of the tray 10. In this embodiment, the first end 21 of the cord 20 may be folded back onto a portion of the remaining length of the cord 20, which first end and remaining length of the cord may be secured to each other by way of a crimp.

Figure 2A:
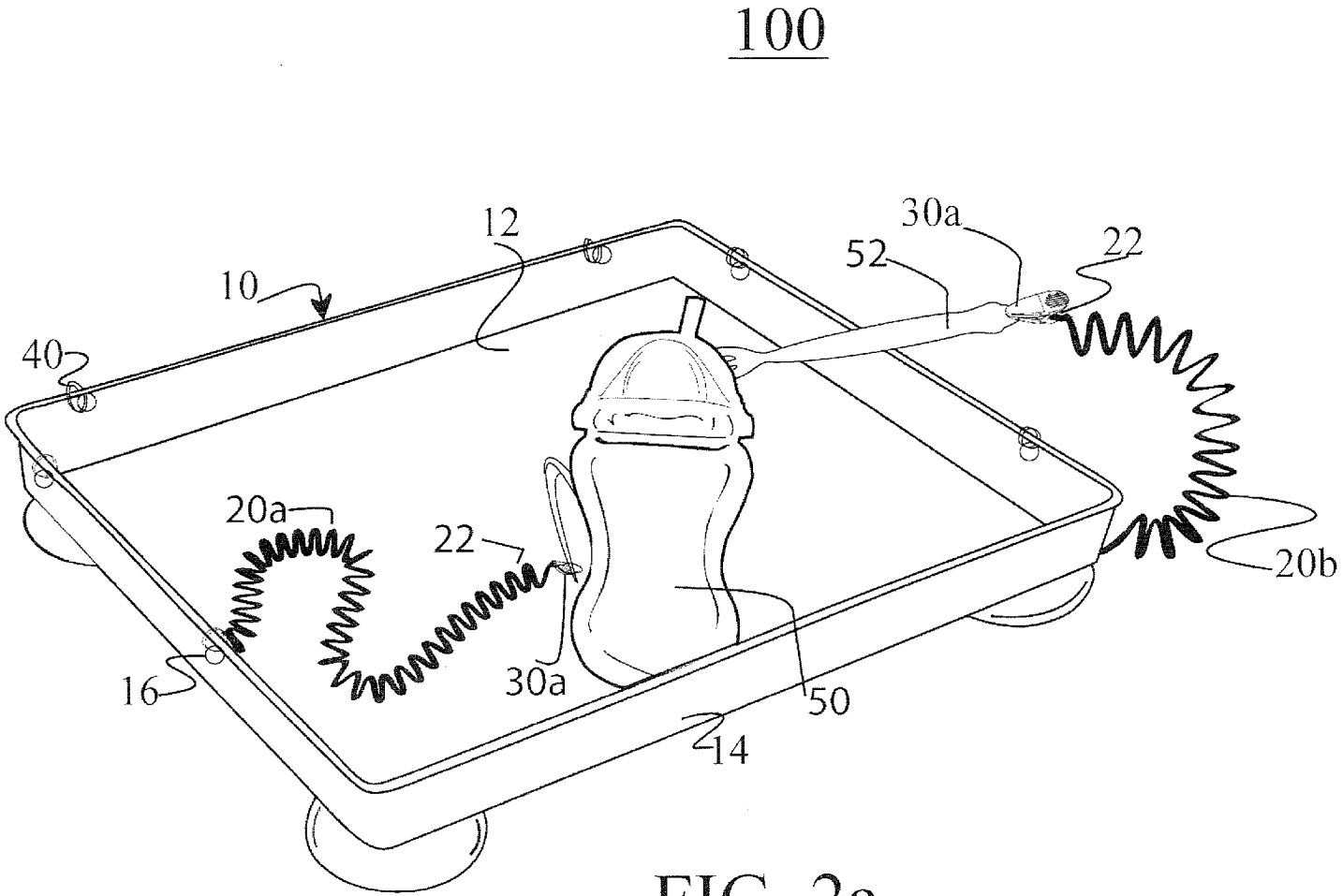
FIGS. 2A and 2B illustrate items attached to a tray system, in accordance with an embodiment of the present disclosure.
Figure 2B:
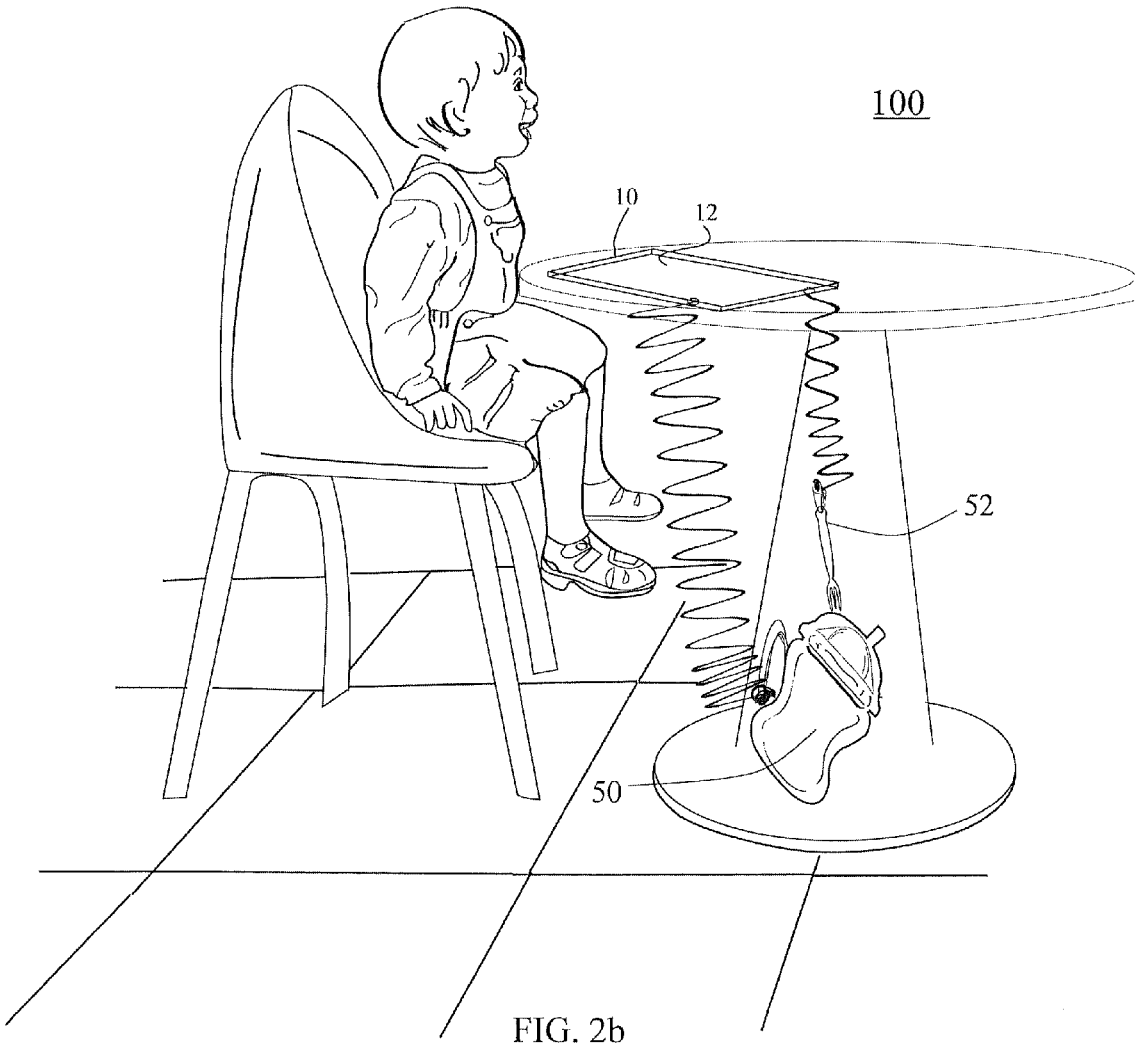

When the at least one cord 20 is attached to the tray 10, a user may secure an item of dishware, flatware and/or drinkware (or any item as previously stated) to the second end 22 of the at least one cord. Shown in FIG. 2A, and by way of example, a cup 50 (such as a child's sippy cup) is attached to the second end 22 of a cord 20*a* by way of an elastic loop 30*a*, and a fork 52 is attached to the second end 22 of a cord 20*b* by way of an clip 30*b*. The cup 50 and the fork 52 are stored on the platform section 12 of the tray 10 and are ready for use. Referring now to FIG. 2B, the cup 50 and fork 52 are shown as being dislodged from the platform section 12 of the tray 10. It will be apparent that the cup 50 and fork 52 remain away from the floor on which the system 100 is placed, such that the cup 50 and fork 52 are not contaminated by any unsanitary conditions of the floor, and further, that the cup 50 and fork 52 remain accessible to the user of the system 100 or his or her caregiver, such that the cup 50 and fork 52 may easily be retrieved and placed back up on the tray 10.

In another embodiment, a food item (not shown) is attached to the second end 22 of a cord 20 by way of a pin (not shown) disposed on the second end 22 of the cord. The user may stick the pin into the food item (such as an apple or banana or other item with a readily-penetrable surface) such that the food item may be attached to the cord and may be prevented from falling to the floor if it is dislodged from the platform section 12 of the tray 10.

Figure 3A:
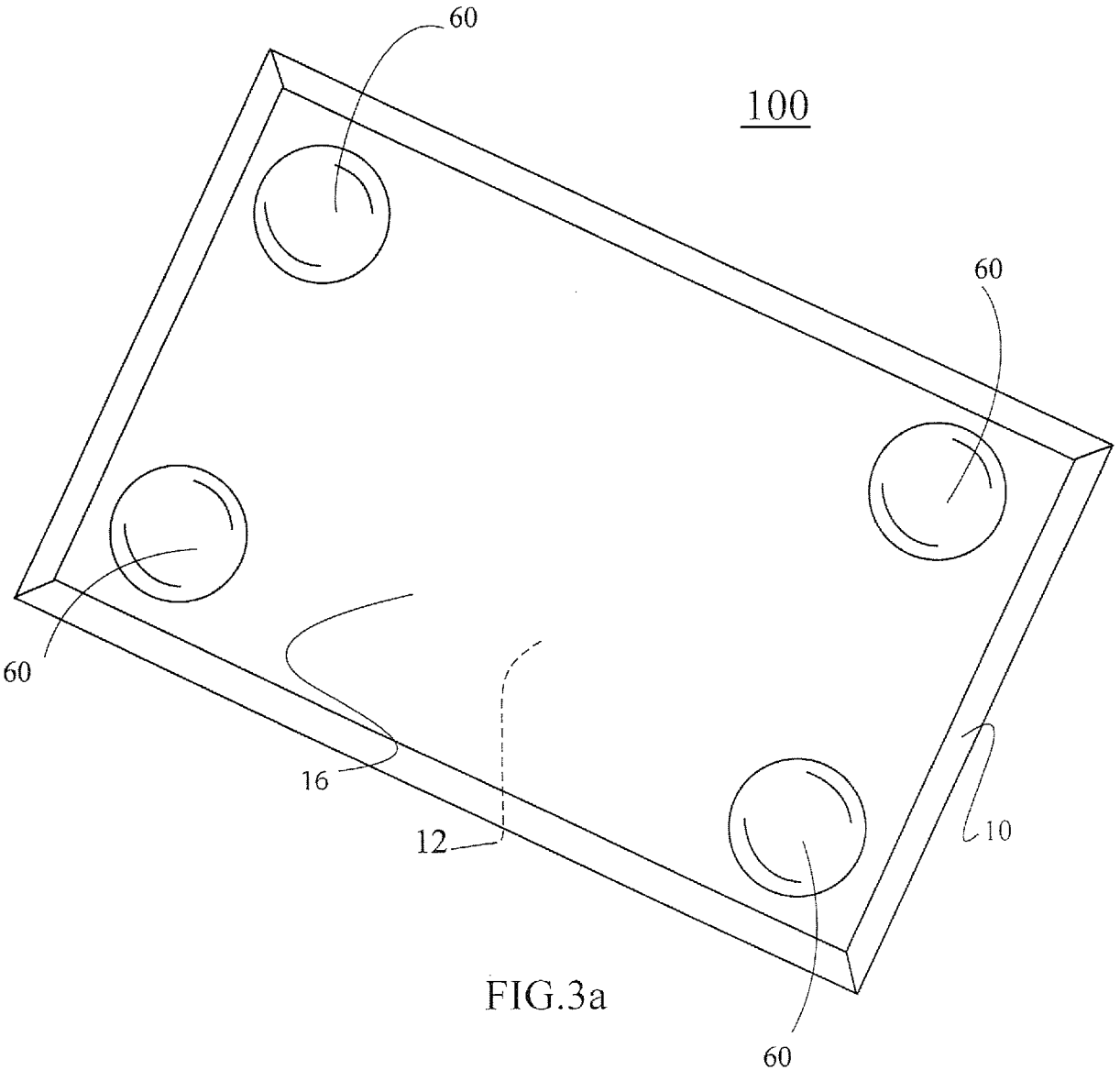
FIG. 3 illustrates a fastener of a tray system, in accordance with an embodiment of the present disclosure.
Figure 3B:
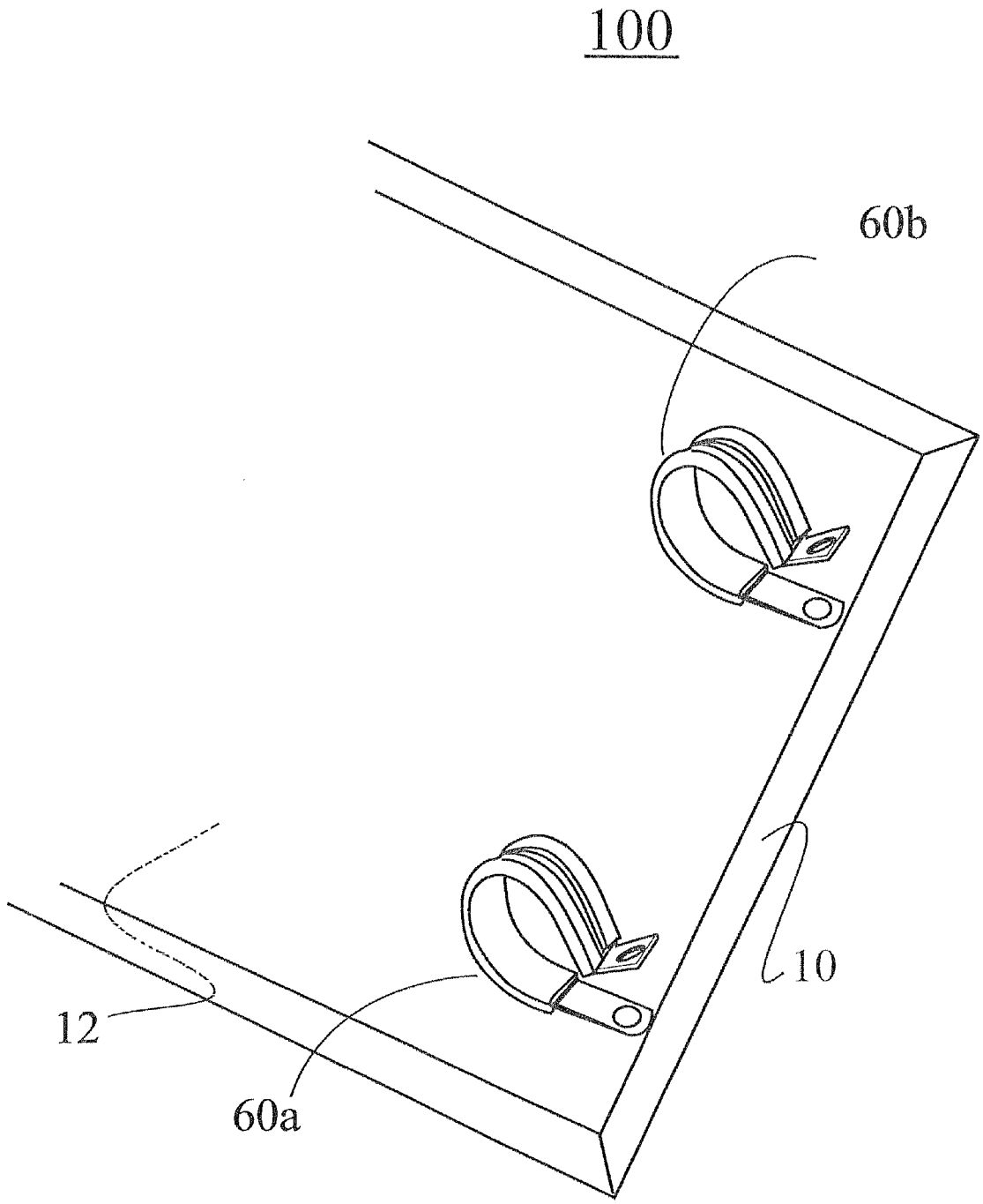

In another embodiment, and referring now FIG. 3A, a tray 10 of a tray system 100 further provides at least one fastener 60 on an underside 16 of the platform section 12 of the tray, which at least one fastener 60 may securely attach the tray of the tray system to a surface such as a table. Examples of such at least one fastener include, but are not necessarily limited to suction cups, clamps, straps, and the like. Where the tray system comprises suction cups as the at least one fastener, it will be apparent that a user may apply pressure to the tray system 100 to cause the suction cups to adhere to a surface on which the tray system 100 is to be placed, and thus, the suction cups will secure the tray 10 to a surface. It will be apparent that the at least one fastener 60 may be removably or permanently attached to the underside 16 of the platform section 12 of the tray.

Where the tray system comprises clamps as the at least one fastener 60, and as shown as an exemplary embodiment in FIG. 3B, a user may employ the clamps to attach the tray system to the frame of a wheel chair or a walker. Shown in FIG. 3B is a tray system 100, wherein the at least one fastener 60 comprises clamps 60*a* and 60*b* disposed in proximity to one side of the tray system 100. In this embodiment, the claims 60*a* and 60*b* extend downwardly away from (and perpendicular to) the underside of the platform section 12 of the tray such that the clamps may attach to a top side of a arm of a wheelchair or a walker. The clamps 60*a* and 60*b* will be substantially aligned, such that, when they are attached to an arm of a wheelchair or a walker (not shown), they will secure the tray 10 of the tray system to the wheelchair or walker such that the tray 10 is oriented in a convenient configuration for the user or his or her caregiver to store food items and/or utensils thereon. The at least one fastener 60 prohibits the user and/or his or her caregiver from upsetting the tray 10 during the feeding process, thus reducing the risk of items being spilled from the tray onto the user, floor, or elsewhere.

In another embodiment, the at least one faster 60 disposed on the underside of the platform section 12 of the tray may extend parallel to the platform section 12 of the tray, such that the at least one fastener may attach the tray 10 to an item or attachment point that is lateral, as opposed to underneath, the tray 10.

Figure 4:
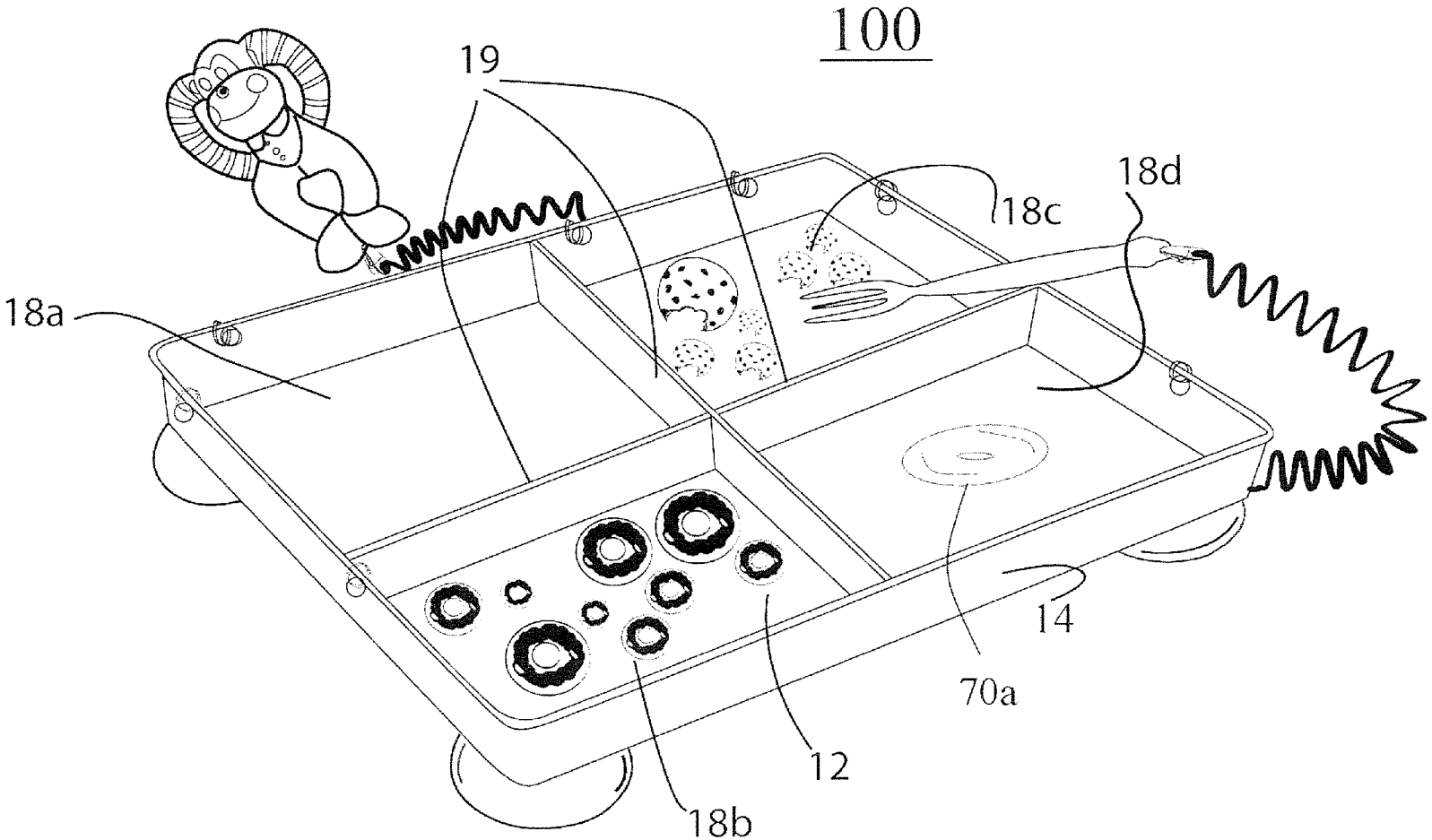
FIG. 4 illustrates compartments of a tray system, in accordance with an embodiment of the present disclosure.

In another embodiment, and referring now FIG. 4, the tray 10 of the system 100 comprises a plurality of compartments 18, which compartments are disposed on the platform section 12 of the tray 10. The compartments 18 are preferably formed by a plurality of interior walls 19 that extending upwardly away from the platform section 12 at an interior of the platform section 12. As shown in FIG. 4 by way of example, two interior walls extend across the interior of the platform section 12 and intersect in a central point on the platform section 12, to form four compartments 18*a*, 18*b*, 18*c*, and 18*d*. In an embodiment, the interior walls may extend approximately one inch above the platform section 12 of the tray 10. The compartments 18 so formed by the interior walls 19 permit a user or his or her caregiver may utilize the plurality of compartments to prevent one food item from mixing with another food item and from otherwise keeping items separate from one another to reduce contamination of one item on the tray by another item on the tray. Optionally, a lid or cover may be provided to enclose a compartment 18 for keeping a food item warm or protected from outside elements.

At least one fastener 70 may be disposed on a top side of the platform section 12 of the tray 10 which at least one fastener may secure items within the platform section 12 of the tray 10. In an embodiment, a suction cup 70*a* may be disposed on a top side of the tray for securing a book or plate to the platform section 12 of the tray 10.

The tray system 100 may further comprise a carrying case or lightweight bag for storing the tray system 100 and its components while not in use, and for protecting the tray system 100 from damage while in transit. The tray 10 of the tray system 100 may be comprised of lightweight plastic or fiberglass or other similar resilient washable material. The components may be produced in various colors and may be produced in bright color schemes that may be attractive to young users.

A tray system, such as the tray system 100, and a tray such as the tray 10, are advantageous in reducing food waste, reducing contamination of food items, toys, dishware, flatware, and drinkware (and any other similar items), and in facilitating retrieval of items that would otherwise be dropped onto a floor during feeding or other activities. The system eases the feeding process of toddlers and children and of incapacitated individuals and also may reduce the frustration that toddlers, children and others would otherwise experience if food items and/or utensils were to be dislodged from an eating area such as a tray. The system further reduces the loss or theft of valuable food items and dishware, flatware, and drinkware due to their attachment to the tray of the tray system disclosed herein.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present disclosure.

What is claimed is:

1. A tray system for securing and retaining items, the system comprising a tray, at least one fastener disposed on an underside of the platform section of the tray, and at least one cord attached to the tray, wherein the tray comprises a substantially flat platform section and a plurality of exterior walls extending upwardly away from the platform section at a periphery of the platform section, wherein the at least one cord comprises a first end and a second end, wherein said first end is attached to at least one exterior wall of the plurality of exterior walls of the tray, and wherein said second end comprises engagement features for attaching an item to said at least one cord.

2. The tray system of claim 1, wherein said first end of the at least one cord is attached to said tray by way of a fastener arrangement.

3. The tray system of claim 2, wherein said fastener arrangement comprises one of an aperture disposed on an exterior wall of the tray, a bolt snap attached to an aperture disposed on an exterior wall of the tray, a ring disposed through an aperture disposed on an exterior wall of the tray, a clip, and a crimp.

4. The tray system of claim 1, wherein the engagement features of said second end of the at least one cord comprises one of a clip, a clamp, an elastic band, a hook, and a pin.

5. The tray system of claim 1, wherein the at least one fastener comprises a suction cup.

6. The tray system of claim 1, wherein the at least one fastener comprises a clamp.

7. The tray system of claim 1, wherein the at least one fastener comprises a strap.

8. The tray system of claim 1, wherein the tray comprises a plurality of compartments disposed on the platform section of the tray, which compartments are formed from a plurality of walls that extend upwardly away from the platform section of the tray.

9. The tray system of claim 1, wherein the tray comprises a fastener disposed on a top side of the platform section of the tray.

10. The tray system of claim 9, wherein the fastener comprises a suction cup.

11. A tray for securing and retaining items, wherein the tray comprises a substantially flat platform section and a plurality of exterior walls extending upwardly away from the platform section at a periphery of the platform section, at least one fastener disposed on an underside of the platform section of the tray, and wherein at least one cord is attached to the tray, wherein the tray comprises a substantially flat platform section and a plurality of exterior walls extending upwardly away from the platform section at a periphery of the platform section, wherein the at least one cord comprises a first end and a second end, wherein said first end is attached to at least one exterior wall of the plurality of exterior walls of the tray, and wherein said second end comprises engagement features for attaching an item to said at least one cord.

* * * * *